US009470435B2

(12) United States Patent
Hinde et al.

(10) Patent No.: US 9,470,435 B2
(45) Date of Patent: Oct. 18, 2016

(54) MODULAR CO2 REFRIGERATION SYSTEM

(71) Applicant: Hill Phoenix, Inc., Conyers, GA (US)

(72) Inventors: David K. Hinde; Shitong Zha, Snellville, GA (US); Lin Lan, Loganville, GA (US); J. Scott Martin, Conyers, GA (US); John M. Gallaher, Atlanta, GA (US)

(73) Assignee: Hill Phoenix, Inc., Conyers, GA (US)

( * ) Notice: Subject to any disclaimer, the term of this patent is extended or adjusted under 35 U.S.C. 154(b) by 509 days.

(21) Appl. No.: 14/137,072

(22) Filed: Dec. 20, 2013

(65) Prior Publication Data

US 2014/0102132 A1 Apr. 17, 2014

Related U.S. Application Data

(63) Continuation of application No. 12/187,957, filed on Aug. 7, 2008, now Pat. No. 8,631,666.

(51) Int. Cl.

| | |
|---|---|
| ***F25B 7/00*** | (2006.01) |
| ***A47F 3/04*** | (2006.01) |
| ***F25B 43/00*** | (2006.01) |
| ***F25B 9/00*** | (2006.01) |
| ***F25B 5/02*** | (2006.01) |
| *F25B 40/00* | (2006.01) |

(52) U.S. Cl.

CPC ..... *F25B 9/008* (2013.01); *F25B 5/02* (2013.01); *F25B 7/00* (2013.01); *F25B 43/006* (2013.01); *F25B 40/00* (2013.01); *F25B 2309/06* (2013.01); *F25B 2400/075* (2013.01); *F25B 2400/22* (2013.01); *F25B 2400/23* (2013.01)

(58) Field of Classification Search

CPC ..... F25B 7/00; F25B 5/02; F25B 43/006; F25B 2400/22; F25B 2400/23

USPC ..... 62/79, 246, 252, 335, 512

See application file for complete search history.

(56) References Cited

U.S. PATENT DOCUMENTS

| | | | |
|---|---|---|---|
| 4,441,872 | A | 4/1984 | Seale |
| 6,089,033 | A | 7/2000 | Dube |
| 6,286,322 | B1 | 9/2001 | Vogel et al. |

(Continued)

FOREIGN PATENT DOCUMENTS

| | | | |
|---|---|---|---|
| WO | WO-2009/158612 | A2 | 12/2009 |
| WO | WO-2010/045743 | A1 | 4/2010 |

*Primary Examiner* — M. Alexandra Elve
*Assistant Examiner* — Daniel C Comings
(74) *Attorney, Agent, or Firm* — Foley & Lardner LLP

(57) ABSTRACT

A cascade CO2 refrigeration system includes a medium temperature loop for circulating a medium refrigerant and a low temperature loop for circulating a CO2 refrigerant. The medium temperature loop includes a heat exchanger having a first side and a second side. The first side evaporates the medium temperature refrigerant. The low temperature loop includes a discharge header for circulating the CO2 refrigerant through the second side of the heat exchanger to condense the CO2 refrigerant, a liquid-vapor separator collects liquid CO2 refrigerant and directs vapor CO2 refrigerant to the second side of the heat exchanger. A liquid CO2 supply header receives liquid CO2 refrigerant from the liquid-vapor separator. Medium temperature loads receive liquid CO2 refrigerant from the liquid supply header for use as a liquid coolant at a medium temperature. An expansion device expands liquid CO2 refrigerant from the liquid supply header into a low temperature liquid-vapor mixture for use by the low temperature loads.

29 Claims, 9 Drawing Sheets

(56) References Cited

U.S. PATENT DOCUMENTS

| | | | |
|---|---|---|---|
| 6,449,967 | B1 | 9/2002 | Dube |
| 6,481,231 | B2 | 11/2002 | Vogel et al. |
| 6,574,978 | B2 | 6/2003 | Flynn et al. |
| 6,722,145 | B2 | 4/2004 | Podtchereniaev et al. |
| 6,775,993 | B2 | 8/2004 | Dube |
| 6,843,065 | B2 | 1/2005 | Flynn |
| 6,968,708 | B2 | 11/2005 | Gopalnarayanan et al. |
| 6,983,613 | B2 | 1/2006 | Dube |
| 6,993,918 | B1 | 2/2006 | Cowans |
| 7,000,413 | B2 | 2/2006 | Chen et al. |
| 7,065,979 | B2 | 6/2006 | Arshansky et al. |
| RE39,924 | E | 11/2007 | Dube |
| 7,424,807 | B2 | 9/2008 | Sienel |
| 7,610,766 | B2 | 11/2009 | Dube |
| 7,628,027 | B2 | 12/2009 | Shapiro |
| 7,878,023 | B2 | 2/2011 | Heinbokel |
| 7,913,506 | B2 | 3/2011 | Bittner et al. |
| 8,113,008 | B2 | 2/2012 | Heinbokel et al. |
| 2007/0089453 | A1 | 4/2007 | Shapiro |
| 2008/0289350 | A1 | 11/2008 | Shapiro |
| 2009/0000321 | A1 | 1/2009 | Hall |
| 2009/0019878 | A1 | 1/2009 | Gupte |
| 2009/0025404 | A1 | 1/2009 | Allen |
| 2009/0120108 | A1 | 5/2009 | Heinbokel et al. |
| 2009/0120117 | A1* | 5/2009 | Martin ..... F25B 7/00 62/246 |
| 2009/0158612 | A1 | 6/2009 | Thilly et al. |
| 2009/0260389 | A1 | 10/2009 | Dube |
| 2009/0272128 | A1 | 11/2009 | Ali |
| 2010/0023171 | A1 | 1/2010 | Bittner et al. |
| 2010/0031697 | A1 | 2/2010 | Hinde et al. |
| 2010/0071391 | A1 | 3/2010 | Lifson et al. |
| 2010/0077777 | A1 | 4/2010 | Lifson et al. |
| 2010/0115975 | A1 | 5/2010 | Mitra et al. |
| 2010/0132399 | A1 | 6/2010 | Mitra et al. |
| 2010/0314843 | A1 | 12/2010 | Beck |
| 2010/0314846 | A1 | 12/2010 | Zeng |

* cited by examiner

MODULAR CO2 REFRIGERATION SYSTEM

CROSS REFERENCE TO RELATED APPLICATIONS

This Application claims the benefit of priority as a continuation of U.S. patent application Ser. No. 12/187,957, filed on Aug. 7, 2008, the complete disclosure of which is incorporated herein by reference.

FIELD

The present invention relates to a refrigeration system with a low temperature portion and a medium temperature portion. The present invention relates more particularly to a refrigeration system where the low temperature portion may receive condenser cooling from refrigerant in the medium temperature portion in a cascade arrangement, or may share condenser cooling directly with the medium temperature system. The present invention relates more particularly to use of carbon dioxide (CO2) as both a low temperature refrigerant and a medium temperature coolant.

BACKGROUND

Refrigeration systems typically include a refrigerant that circulates through a series of components in a closed system to maintain a cold region (e.g., a region with a temperature below the temperature of the surroundings). One exemplary refrigeration system is a vapor refrigeration system including a compressor. Such a refrigeration system may be used, for example, to maintain a desired temperature within a temperature controlled storage device, such as a refrigerated display case, coolers, freezers, etc. The refrigeration systems may have a first portion with equipment intended to maintain a first temperature (such as a low temperature) and a second temperature (such as a medium temperature). The refrigerant in the low temperature portion and the refrigerant in the medium temperature portion are condensed in condensers which require a source of a coolant.

Different refrigerants maybe be used in different vapor compression refrigeration systems to maintain cases at several different temperatures. However, using different refrigerants typically requires separate closed loop systems and additional piping and equipment.

Further, with a traditional refrigeration system, if the amount of space needing for cooling is increased, for instance, by adding additional chilled display cases, equipment such as compressors may have to be replaced to accommodate the additional cooling load.

Accordingly, it would be desirable to provide a modular refrigeration system capable of using CO2 as a refrigerant for cooling refrigeration devices operating at different temperatures.

SUMMARY

One embodiment of the invention relates to a cascade CO2 refrigeration system, comprising a medium temperature loop for circulating a medium temperature refrigerant and a low temperature loop for circulating a CO2 refrigerant. The medium temperature loop including a compressor; a discharge header; a condenser; a subcooler; an expansion device; and a heat exchanger having a first side and a second side. The first side of the heat exchanger is configured to evaporate the medium temperature refrigerant. The medium temperature loop further includes a suction header configured to direct medium temperature refrigerant to the compressor. The low temperature loop includes a compressor, a discharge header configured to circulate the CO2 refrigerant through the second side of the heat exchanger to condense the CO2 refrigerant; a liquid-vapor separator configured to collect liquid CO2 refrigerant and to direct vapor CO2 refrigerant to the second side of the heat exchanger; a pump; a subcooler; a liquid CO2 refrigerant supply header; a plurality of medium temperature loads configured to receive liquid CO2 refrigerant from the liquid CO2 refrigerant supply header for use as a liquid coolant in the medium temperature loads; a plurality of low temperature loads; and a low temperature expansion device configured to expand the liquid CO2 refrigerant from the liquid CO2 refrigerant supply header into liquid-vapor CO2 for use as a refrigerant by the low temperature loads.

Another embodiment relates to a cascade refrigeration system having a common subcooled liquid supply for both low temperature refrigerated cases and medium temperature refrigerated cases. The system includes an upper cascade portion for circulating a first refrigerant; lower cascade portion for circulating a second refrigerant; a plurality of medium temperature refrigerated cases configured to receive liquid second refrigerant from the common subcooled liquid supply for use as a coolant in the medium temperature refrigerated cases, and an expansion device configured to expand the liquid second refrigerant from the common subcooled liquid supply into liquid-vapor second refrigerant for use as a refrigerant by the low temperature refrigerated cases. The upper cascade portion includes a compressor, a condenser, an expansion device, and a heat exchanger having a first side and a second side, the first side configured to evaporate the first refrigerant. The lower cascade portion includes a compressor configured to direct the second refrigerant to the second side of the heat exchanger, the second side of the heat exchanger configured to condense the second refrigerant, a liquid-vapor separator configured to direct liquid second refrigerant to the common subcooled liquid supply and to direct vapor second refrigerant to the second side of the heat exchanger.

Yet another embodiment relates to a cascade refrigeration system having a common liquid supply for both low temperature refrigeration loads and medium temperature refrigeration loads. The system includes an upper cascade portion for circulating a first refrigerant, a lower cascade portion for circulating a second refrigerant, and a liquid-vapor separator. The upper cascade portion including a compressor, a condenser, an expansion device, and a heat exchanger having a first side and a second side, the first side configured to evaporate the first refrigerant. The lower cascade portion including a compressor configured to direct the second refrigerant to the second side of the heat exchanger, the second side of the heat exchanger configured to condense the second refrigerant. The liquid-vapor separator configured to receive the liquid second refrigerant from the second side of the heat exchanger and to provide a source of liquid second refrigerant for the common liquid supply. The medium temperature refrigeration loads are configured to receive liquid second refrigerant from the common liquid supply for use as a coolant. Expansion devices are configured to expand the liquid second refrigerant from the common liquid supply into a liquid-vapor mixture for use as a second refrigerant in the low temperature refrigeration loads.

Still another embodiment relates to a refrigeration system comprising a plurality of modular medium temperature compact chiller, a plurality of modular low temperature compact condenser units, a liquid-vapor separator communicating with the modular low temperature compact condenser units, and a pump. The modular medium temperature compact chiller units have a first heat exchanger and a second heat exchanger. The modular medium temperature compact chiller units are arranged in parallel and configured to circulate a medium temperature refrigerant through the first and second heat exchangers to cool a medium temperature liquid coolant for circulation to a plurality of medium temperature refrigeration loads. The modular low temperature compact condenser units have a first heat exchanger and a second heat exchanger. The modular low temperature compact condenser units are arranged in parallel, with the first heat exchanger configured to receive the medium temperature liquid coolant to condense a low temperature refrigerant for circulation to the first heat exchanger to condense a vapor CO2 refrigerant to a liquid CO2 refrigerant. The liquid-vapor separator communicates with the modular low temperature compact condenser units to direct vapor CO2 refrigerant to the first heat exchanger and to receive liquid CO2 refrigerant from the first heat exchanger. The pump is configured to direct the liquid CO2 refrigerant from the liquid-vapor separator to a plurality of low temperature refrigeration loads.

DETAILED DESCRIPTION

Figure 1:
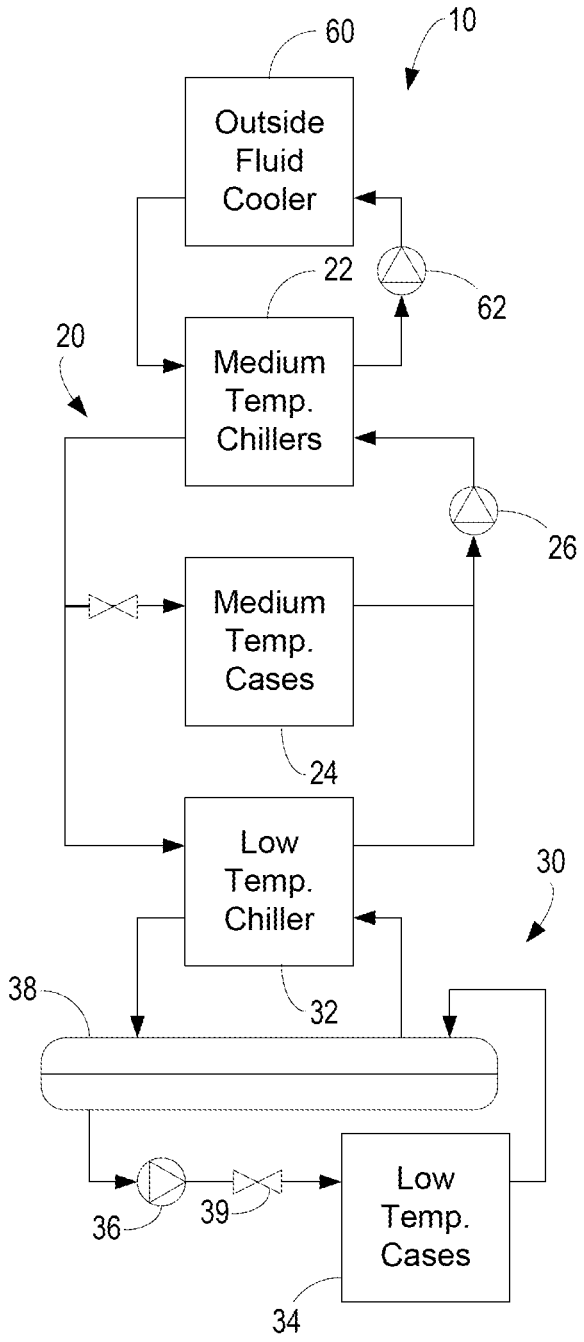
FIG. 1 is a block diagram of a modular cascade refrigeration system according to an exemplary embodiment using a CO2 refrigerant.

Referring to FIG. 1, a refrigeration system 10 is shown according to an exemplary embodiment. Refrigeration systems 10 typically include one or more refrigerants (e.g., a vapor compression/expansion type refrigerant, etc.) that circulate through a series of components in a closed system to maintain a cold region (e.g., a region with a temperature below the temperature of the surroundings). The refrigeration system 10 of FIG. 1 is a cascade system that includes several subsystems or loops. According to an exemplary embodiment, the cascade refrigeration system 10, comprises a medium temperature loop 20 for circulating a medium temperature refrigerant and a low temperature loop 30 for circulating a low temperature CO2 refrigerant.

The terms "low temperature" and "medium temperature" are used herein for convenience to differentiate between two subsystems of refrigeration system 10. Medium temperature loop 20 maintains one or more cases 24 such as refrigerator cases or other cooled areas at a temperature lower than the ambient temperature but higher than low temperature cases 34. Low temperature loop 30 maintains one or more cases 34 such as freezer display cases or other cooled areas at a temperature lower than the medium temperature. According to one exemplary embodiment, medium temperature cases 24 may be maintained at a temperature of approximately 20° F. and low temperature cases 34 may be maintained at a temperature of approximately minus (−) 20° F. Although only two subsystems are shown in the exemplary embodiments described herein, according to other exemplary refrigeration system 10 may include more subsystems that may be selectively cooled in a cascade arrangement or other cooling arrangement.

A first or medium temperature loop 20 (e.g., the upper cascade portion) includes a medium temperature chiller 22 (e.g. modular medium temperature compact chiller unit), one or more medium temperature cases 24 (e.g., refrigerated display cases), and a pump 26. Pump 26 circulates a medium temperature liquid coolant (e.g., propylene glycol, water, etc.) between chiller 22 and cases 24 to maintain cases 24 at a relatively constant medium temperature. Medium temperature chiller 22 removes heat energy from medium temperature cases 24 and, in turn, gives the heat energy up to a heat exchanger, such as an outdoor fluid cooler 60 or outdoor cooling tower to be dissipated to the exterior or outside environment. Outdoor fluid cooler 60 cools a third coolant (e.g., water, etc.) that is circulated with a pump 62.

Figure 5:
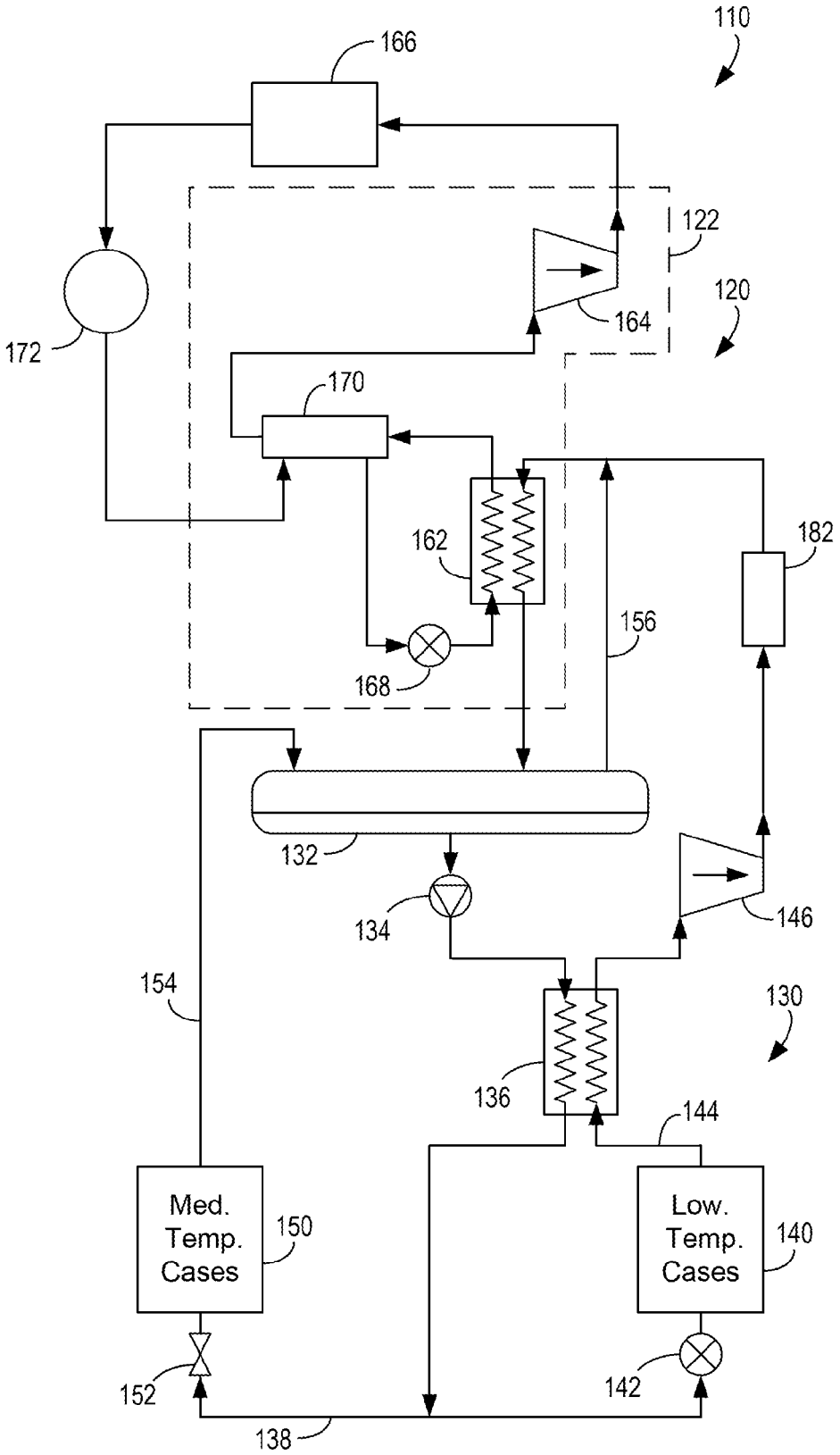
FIG. 5 is a block diagram of a cascade refrigeration system according to an exemplary embodiment using a CO2 refrigerant for both medium temperature cases and low temperature cases.
Figure 6:
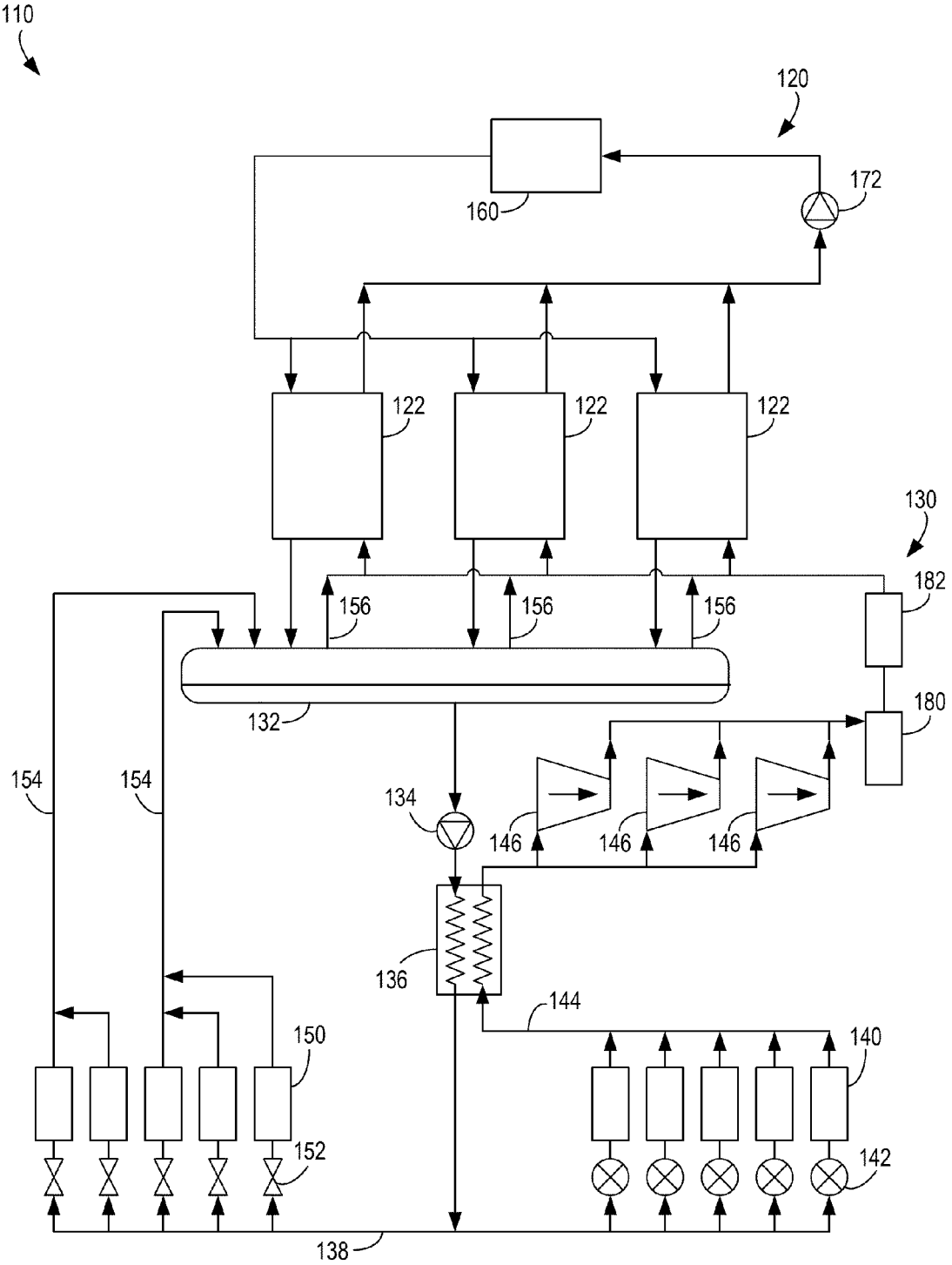
FIG. 6 is a block diagram of one modular embodiment of the refrigeration system of FIG. 5.
Figure 7:
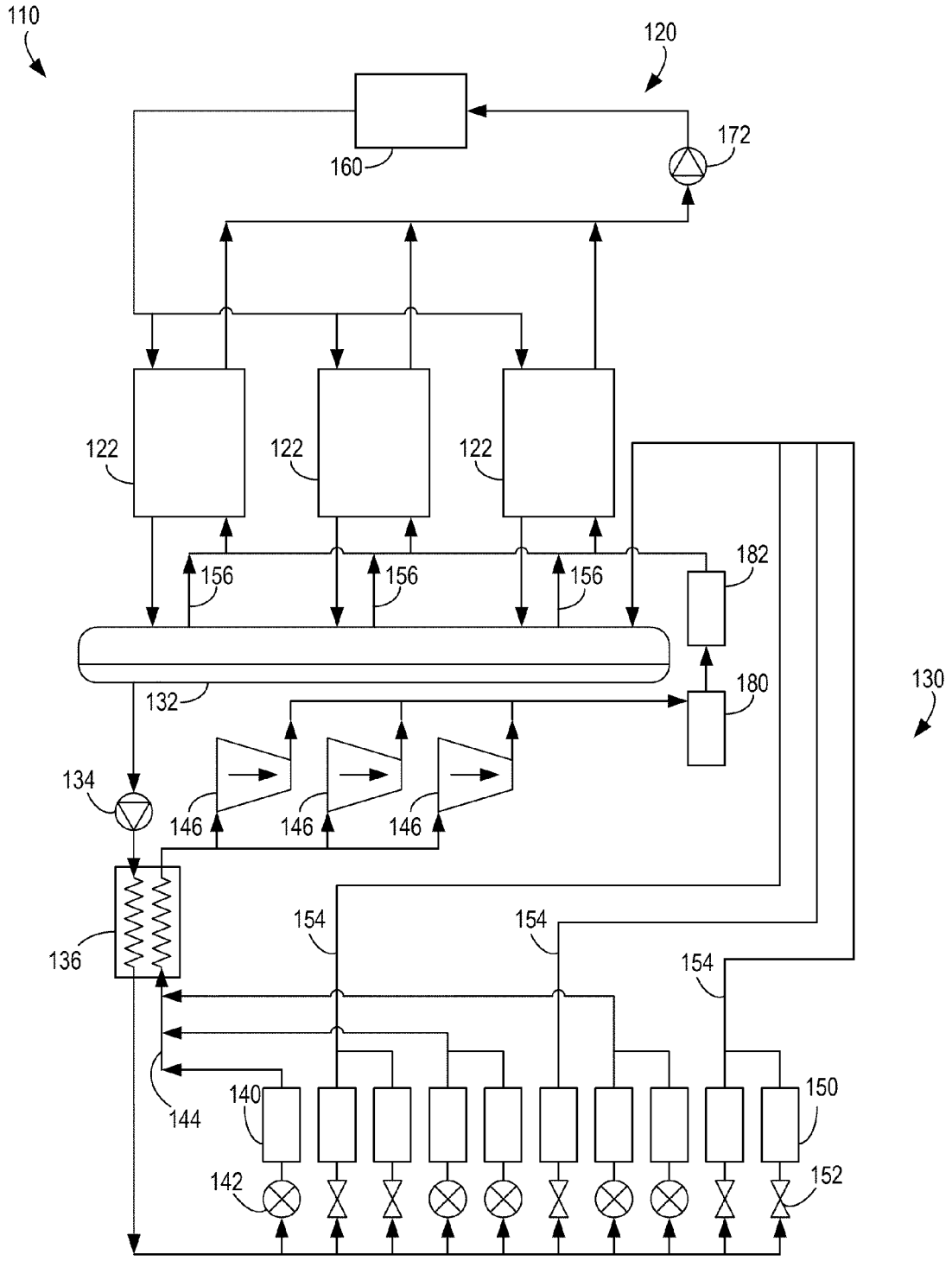
FIG. 7 is a block diagram of one modular embodiment of the refrigeration system of FIG. 5.

Medium temperature chiller 22 is further coupled to a low-temperature chiller 32 (e.g. modular low temperature compact condenser units) to absorb (e.g. remove, etc.) heat from a low temperature loop 30. The second or low temperature loop 30 (e.g., the lower cascade portion) includes a low temperature chiller 32, one or more low temperature cases 34 (e.g., refrigerated display cases, freezers, etc.), and a pump 36. Pump 36 circulates a low temperature coolant (e.g., carbon dioxide) between chiller 32 and refrigerated cases 34 to maintain cases 34 at a relatively constant low temperature. The carbon dioxide (CO2) coolant is separated into liquid and gaseous portions in a receiver or liquid-vapor separator 38. Liquid CO2 exits the liquid-vapor separator 38 and is pumped by pump 36 to valve 39 (which may be an expansion valve for expanding liquid CO2 into a low temperature saturated vapor for removing heat from low temperature cases 34, and would be returned to the suction of a compressor, such as shown in FIGS. 5-7. According to another exemplary embodiment, CO2 enters low temperature cases 34 as a liquid coolant. After absorbing heat from low temperature cases 34, the CO2 coolant returns to liquid-vapor separator 38 through a return header. Liquid-vapor separator 38 communicates with low temperature chiller 32 to direct vapor CO2 refrigerant to chiller 32 and to receive liquid CO2 refrigerant from chiller 32. Gaseous CO2 is received by low temperature chiller 32, which in turn transfers heat from low temperature cases 34 to medium temperature chillers 22.

Figure 2:
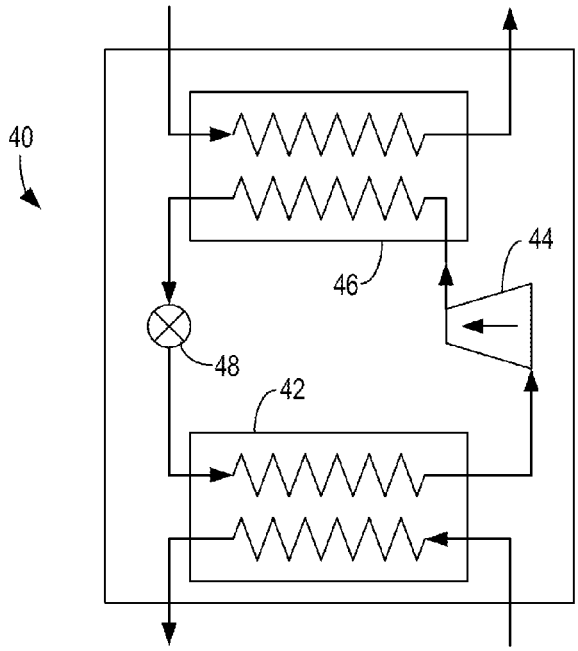
FIG. 2 is a block diagram of a chiller unit for the refrigeration system of FIG. 1 according to one exemplary embodiment.

One exemplary chiller unit 40 is shown in FIG. 2 and may be either a medium temperature chiller 22 or a low temperature chiller 32. Chiller unit 40 includes a refrigerant that is circulated through a vapor-compression refrigeration cycle including a first heat exchanger 42, a compressor 44, a second heat exchanger 46, and an expansion valve 48. In the first heat exchanger 42, the refrigerant absorbs heat from an associated load such as display case(s) or other cooled area via a coolant circulated by a pump (e.g. pump 36 for low temperature cases, pump 26 for medium temperature cases, etc.). In the second heat exchanger 46 (e.g. condenser, etc.), the refrigerant gives up heat to a second coolant. Various elements of the chiller unit 40 may be combined. For example, heat exchangers 42 and 46 may comprise a single device in one exemplary chiller unit 40.

Figure 3:
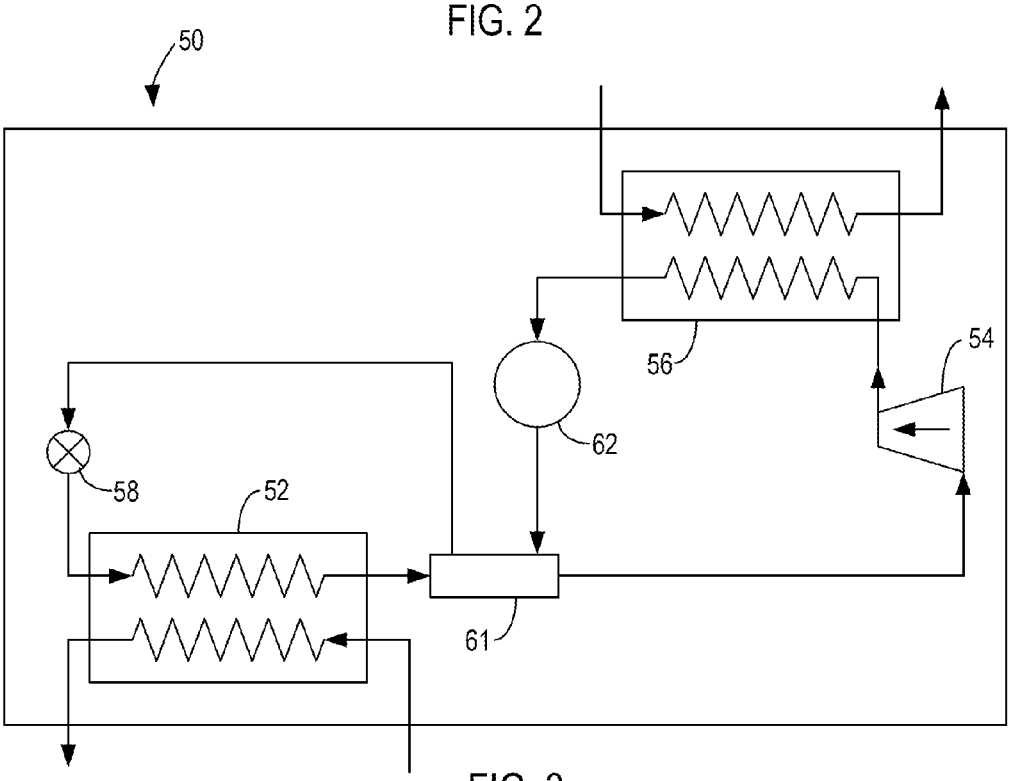
FIG. 3 is a block diagram of a chiller unit for the refrigeration system of FIG. 1 according to another exemplary embodiment.

Another exemplary chiller unit 50 is shown in FIG. 3 and may be either a low temperature chiller 32 or a medium temperature chiller 22. Chiller unit 50 is similar to chiller unit 40 and also includes a refrigerant (e.g., a medium temperature refrigerant or a low temperature refrigerant) that is circulated through a vapor-compression refrigeration cycle including a first heat exchanger 52, a compressor 54, a second heat exchanger 56, and an expansion valve 58. Chiller unit further includes an intermediate heat exchanger 61 (e.g., a subcooler) and a reservoir 62. In the first heat exchanger 52, the refrigerant absorbs heat from an associated display case(s) or other cooled area via a coolant circulated by a pump (e.g. pump 26 for low temperature cases, pump 36 for medium temperature cases, etc.). For example, if chiller 50 is a low temperature chiller of system 10, liquid-vapor separator 38 directs vapor CO2 refrigerant to first heat exchanger 52 and receives liquid CO2 refrigerant from first heat exchanger 52. In the second heat exchanger 56 (e.g. condenser, etc.), the refrigerant gives up heat to a second coolant. Various elements of the chiller unit 50 may be combined. For example, heat exchangers 52 and 56 may comprise a single device in one exemplary chiller unit 50.

Intermediate heat exchanger 61 allows refrigerant exiting second heat exchanger 56 (e.g., as a saturated liquid) to be subcooled further by low temperature refrigerant exiting first heat exchanger 52. By subcooling the refrigerant with heat exchanger 61, the efficiency of the system is increased by reducing premature vaporization or flash off of the refrigerant before it reaches the heat exchanger 52. Further, the subcooled refrigerant is then expanded through expansion valve 58 at a lower enthalpy than it would be if it were not first subcooled. The lower enthalpy vapor refrigerant is then able to absorb more heat as it passes through first heat exchanger 52.

Figure 4:
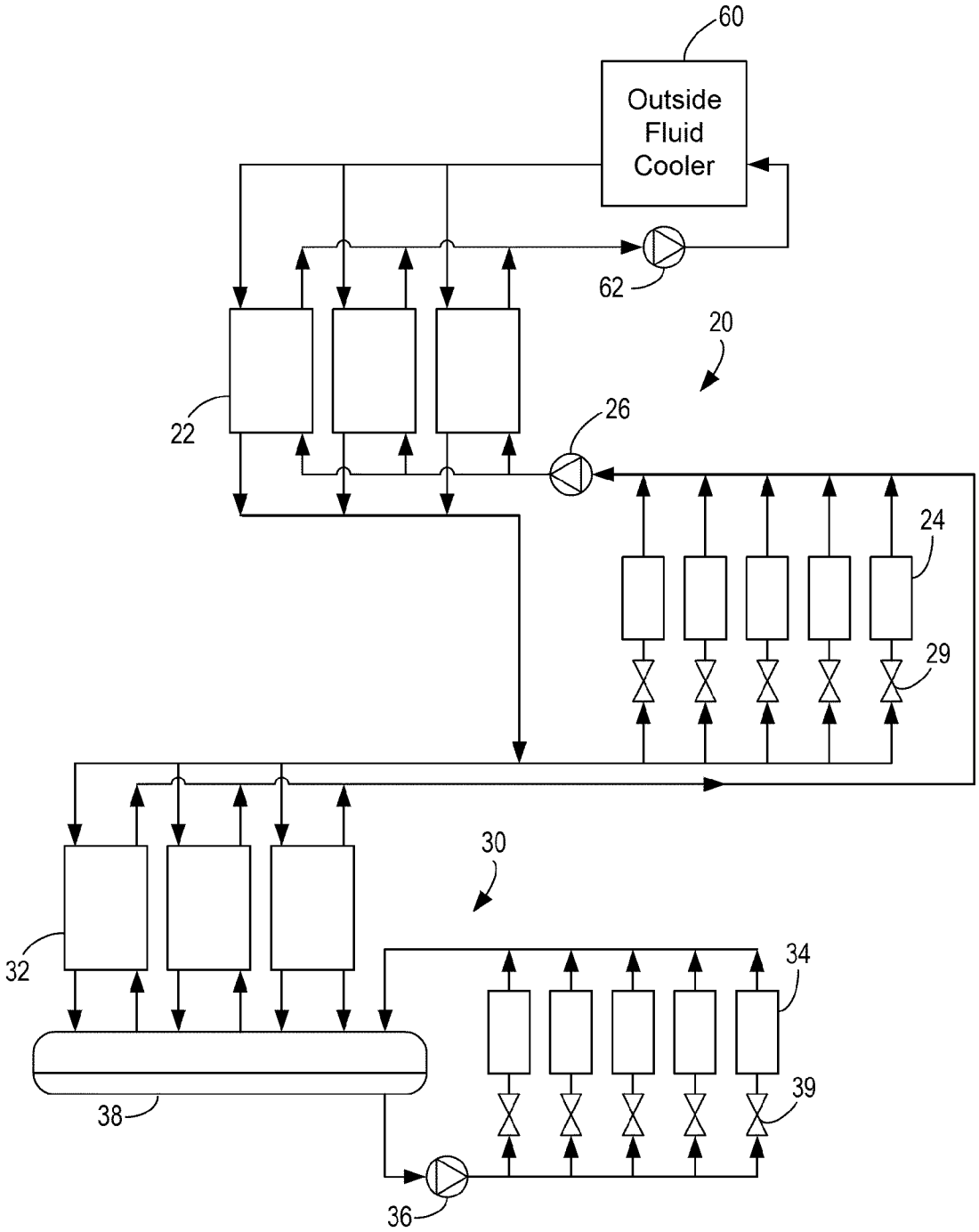
FIG. 4 is a block diagram of one modular embodiment of the refrigeration system of FIG. 1.

According to one exemplary embodiment, chiller unit 40 is a compact modular chiller unit. System 10 may include a multitude of chiller units 40 or 50 arranged in parallel as low temperature chillers (e.g. condensing units) 32 and medium temperature chillers 22. The number of chiller units 40 or 50 may be varied to accommodate various cooling loads associated with a particular system. Likewise, the number of medium temperature cases 24 and low temperature cases 34 may be varied. FIG. 4 shows one exemplary embodiment of a system 10 that is adapted to accommodate multiple medium temperature cooling loads such as medium temperature cases 24 and multiple low temperature cooling loads such as low temperature cases 34 by providing multiple low temperature chillers 32 and multiple medium temperature chillers 22.

Referring now to FIG. 5, a refrigeration system 110 is shown according to another exemplary embodiment. Similar to system 10, system 110 typically includes one or more refrigerants (e.g., a vapor compression/expansion type refrigerant, etc.) that circulate through a series of components in a closed system to maintain a cold region (e.g., a region with a temperature below the temperature of the surroundings). The refrigeration system 110 of FIG. 5 is shown as a cascade system that includes several subsystems or loops. According to an exemplary embodiment the cascade refrigeration system 110 comprises a medium temperature loop 120 for circulating a medium temperature refrigerant and a low temperature loop 130 for circulating a CO2 refrigerant. In contrast to system 10, both medium temperature cases 150 and low temperature cases 140 are cooled by the CO2 refrigerant of low temperature loop 130, using a common liquid CO2 refrigerant supply header 138.

Low temperature loop 130 (e.g., lower cascade portion) includes a CO2 refrigerant that is circulated through a refrigeration cycle including a receiver or liquid-vapor separator 132, a pump 134, a subcooler 136, a common liquid supply header 138, low temperature cases 140 with associated expansion devices 142, medium temperature cases 150 with associated control valves 152, and one or more compressors 146.

Liquid CO2 refrigerant from liquid-vapor separator 132 is circulated by pump 134 to supply header 138 through one side of subcooler 136. Pump 134 pressurizes the CO2 liquid refrigerant. Subcooler 136 allows liquid CO2 refrigerant exiting separator 132 to be subcooled further by low temperature vapor CO2 refrigerant exiting low temperature cases 140. By subcooling the refrigerant with pump 134 and subcooler 136, the efficiency of the system is increased by reducing premature vaporization or flash off of the refrigerant before it reaches the cooling loads. Further, the subcooled refrigerant is expanded through expansion valve 142 at a lower enthalpy than it would be if it were not first subcooled. The lower enthalpy liquid refrigerant is then able to absorb more heat as it passes through low temperature cases 140 and medium temperature cases 150.

Supply header 138 allows liquid CO2 refrigerant to flow to both low temperature cases 140 and medium temperature cases 150. Liquid refrigerant flowing to low temperature cases 140 passes through expansion devices 142 (e.g., expansion valves) expanding to a liquid-vapor mixture. In this way, the CO2 refrigerant is provided as an expansion type refrigerant at a relatively low temperature (e.g. approximately minus (−) 20° F. or other suitable "low" temperature) to cool the low temperature cases 140 (e.g. cooling loads). Liquid refrigerant flowing to medium temperature cases 150, on the other hand, passes through valves 152 and is provided as a liquid refrigerant or coolant at a "medium" temperature (e.g. approximately 20° F. or other suitable "medium" temperature) to cool the medium temperature cases 150 cooling loads. By using a common supply header 138, and passing the refrigerant using different components 142 and 152 before they pass through low temperature cooling cases 140 and medium temperature cooling cases 150, the overall system 10 may be simplified by supplying a common refrigerant through a common header for use in refrigeration loads (e.g. display cases, etc.) having different operating temperature requirements. For instance, in a system with interspersed medium temperature cases 150 and low temperature cases 140 (such as shown in FIG. 7), a single supply header 138 eliminates the need to run two parallel lines to service each type of case.

After the CO2 refrigerant has absorbed heat from low temperature cases 140, a suction header 144 coupled to the low temperature cases 140 directs the CO2 vapor refrigerant through subcooler 136 and to compressor 146. The refrigerant is superheated in subcooler 136 by the warmer CO2 liquid refrigerant from separator 132. By superheating the CO2 vapor refrigerant before it reaches compressor 146, the chances of any damaging moisture or liquids entering compressor 146 are reduced. The CO2 vapor refrigerant is compressed to a high-pressure super-heated vapor in compressor 146 and directed to a heat exchanger 182 (e.g. de-superheater, etc.) shown as located upstream of heat exchanger 162 and intended to pre-cool the compressed CO2 vapor prior to entering heat exchanger 162, in order to reduce the cooling demand or load required by heat exchanger 162. According to one embodiment, heat exchanger 182 is an air-cooled heat exchanger (operating in a manner similar to an air-cooled condenser) that takes advantage of available ambient air cooling to reduce the demand on medium temperature loop 120. According to an alternative embodiment, the de-superheating heat exchanger may also be arranged to selectively "reclaim" the heat from the compressed CO2 vapor for use in other applications (e.g. heating water or air for other uses in a facility, etc.) and as such may be air or liquid cooled as appropriate. According to one exemplary embodiment, the temperature of the compressed vapor discharged from compressor(s) 146 is within a range of approximately 150-165° F., and the medium temperature cooling loop 120 is required to reduce the temperature of the compressed vapor to about 25° F. and then condense the CO2 into liquid form. The applicants believe that use of the de-superheater as described would be effective in reducing the temperature of the compressed vapor to about 110° F. (or lower depending on ambient conditions) prior to entering the heat exchanger 162, resulting in an energy savings of approximately 10% or more. After being cooled by the de-superheating heat exchanger 182, the CO2 refrigerant is directed through valve 155 to heat exchanger 162 in the medium temperature loop. After passing through heat exchanger 162, the refrigerant returns to liquid-vapor separator 132.

Referring further to FIG. 5, the medium temperature case(s) 150 are also shown to receive liquid CO2 as a coolant from common liquid supply header 138 and through valve(s) 152. After the CO2 refrigerant has absorbed heat from medium temperature cases 150 the CO2 refrigerant is typically in a combined liquid-vapor state. A return header 154 directs the CO2 refrigerant back to separator 132. Each case 150 may have an individual line that enters a common suction header rack. In separator 132, the CO2 liquid refrigerant is pumped back to low temperature loop 130 by pump 134, while the CO2 vapor refrigerant is allowed to join CO2 vapor refrigerant from compressor 146 through a return line 156, where it is cooled and condensed in heat exchanger 162 by medium temperature loop 120.

The medium temperature loop 120 (e.g., the upper cascade portion) is similar to chiller unit 50 shown in FIG. 3 and includes a refrigerant (e.g. a medium temperature refrigerant) that is circulated through a vapor-compression refrigeration cycle including a first heat exchanger 162, a compressor 164, a second heat exchanger 166, and an expansion valve 168. Medium temperature loop 120 further includes an intermediate heat exchanger 170 (e.g. a subcooler) and a receiver tank 172. In the first heat exchanger 162, the medium temperature refrigerant (on one side of the heat exchanger) absorbs heat from CO2 vapor refrigerant (on the other side of the heat exchanger) received from compressor 146 and separator 132. The medium temperature refrigerant passes through subcooler 170 where it sub-cools the medium temperature refrigerant returning from second heat exchanger 166, which in turn, superheats the medium temperature refrigerant being routed from the first heat exchanger 162 to the compressor 164. By superheating the medium temperature refrigerant before it reaches compressor 164, the chances of any damaging moisture or liquids entering compressor 164 are reduced. The medium temperature refrigerant is compressed to a super-heated vapor by compressor 164 before being directed to second heat exchanger 166. Second heat exchanger 166 (e.g. condenser, etc.) may transfer heat to the ambient air or may be a heat exchanger that gives up heat to an additional cooling loop, such as the outside fluid cooler loop of system 10. The medium temperature refrigerant is then directed to receiver tank 172 before flowing to subcooler 170. After being cooled in subcooler 170, the refrigerant is expanded through expansion valve 168 before returning to first heat exchanger 162, where it is used to condense the vapor CO2 refrigerant.

Subcooler 170 allows refrigerant exiting second heat exchanger 166 (e.g., as a saturated or subcooled liquid) to be subcooled further by low temperature refrigerant exiting first heat exchanger 162. By subcooling the medium temperature refrigerant with subcooler 170, the efficiency of the system is increased by reducing premature vaporization or flash off of the refrigerant before it reaches the first heat exchanger 162. Further, the subcooled medium temperature refrigerant is then expanded through expansion valve 168 at a lower enthalpy than it would be if it were not first subcooled. The lower enthalpy refrigerant is then able to absorb more heat as it passes through first heat exchanger 162.

One or more components of medium temperature loop 120 may be packaged together as a modular chiller unit 122. According to one exemplary embodiment, modular unit 122 includes first heat exchanger 162, compressor 164, second heat exchanger 166, and expansion valve 168 (in a manner similar to that shown in FIG. 3), and may also include a subcooler 170 (in a manner similar to that shown in FIG. 4). According to another embodiment, the modular unit 122 may also include condenser 166 and receiver 172 as a packaged module, particularly when condenser 166 is provided in the form of a water-cooled heat exchanger. Modular chiller unit 122 allows system 110 to be adapted to accommodate various numbers of medium temperature and low temperature cooling loads. As shown according to several exemplary embodiments in FIGS. 6 and 7, a third cooling loop having an outdoor heat exchanger 160 and pump 172 may be coupled to several modular units 122 to provide a cooling source for the heat removed from the CO2 vapor refrigerant by modular units 122 of system 110. Other components of system 110 may also be provided in a modular manner to provide additional cooling capacity. For example, multiple compressors 146 may be provided between subcooler 136 and modular units 122, and may be provided with other components such as an oil separator 180. The modular nature of system 110 allows a varied number of medium temperature cases 150 and low temperature cases 140 to be cooled. Medium temperature cases 150 and low temperature cases 140 may be segregated as shown in FIG. 6 or may be mixed among each other as shown in FIG. 7.

Figure 8A:
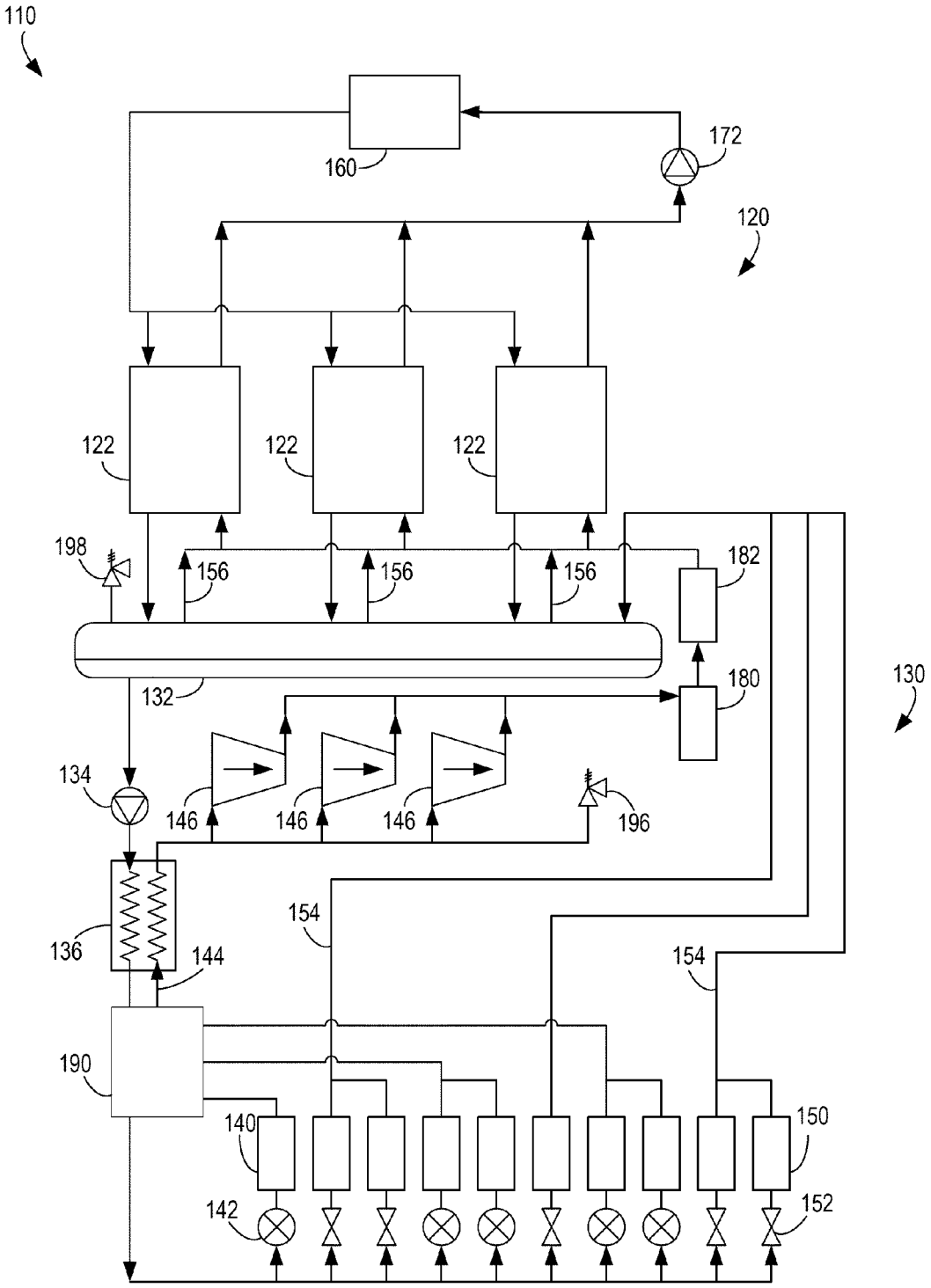
FIG. 8A is a block diagram of one modular embodiment of the refrigeration system of FIG. 5 including several pressure relief components.
Figure 8B:
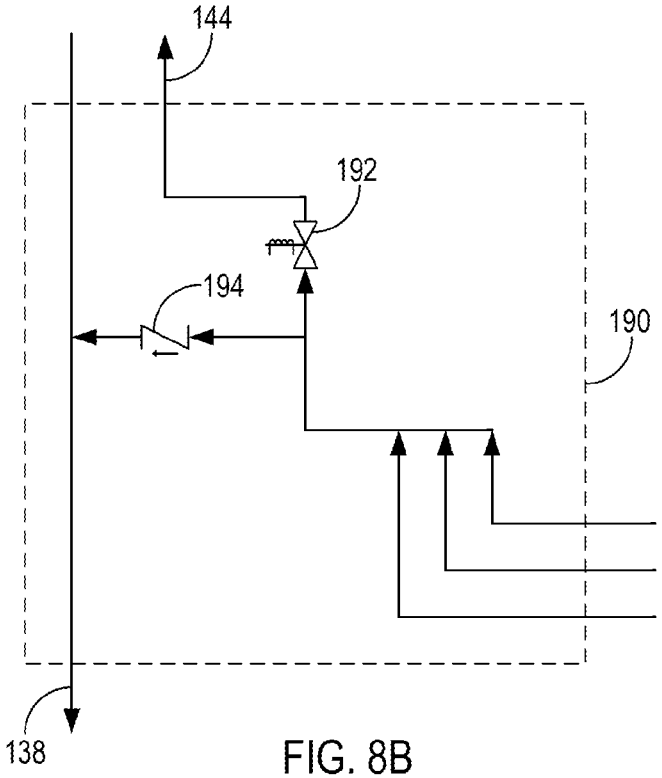
FIG. 8B is a block diagram of a portion of the refrigeration system of FIG. 8A showing one exemplary configuration of several pressure release components.
Figure 8C:
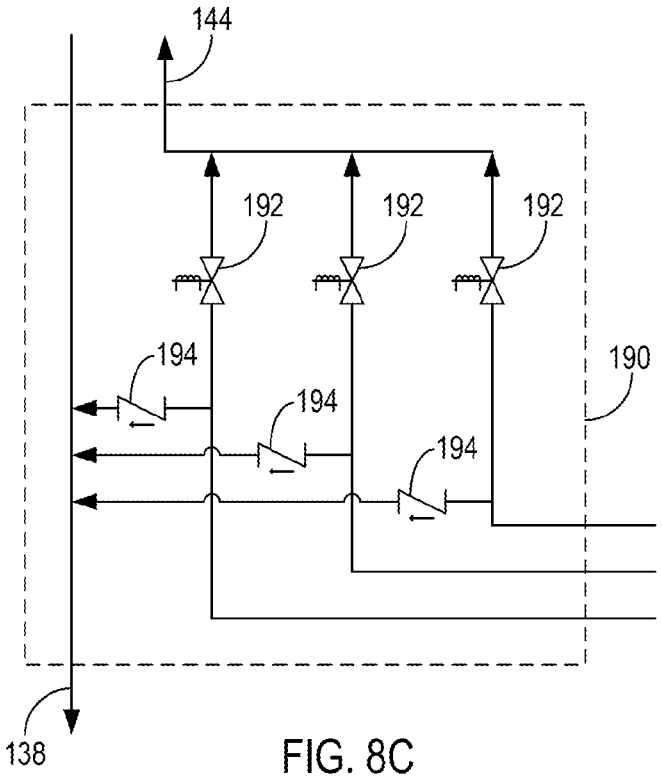
FIG. 8C is a block diagram of a portion of the refrigeration system of FIG. 8A showing one exemplary configuration of several pressure release components.

Referring now to FIGS. 8A-8C, refrigeration system 110 may further include several pressure relief mechanisms. For example, refrigeration system 110 may include pressure limiting devices such as a first or low-side relief valve 196 and a second or high-side relief valve 198. Low-side valve 196 is provided on the low pressure side of low temperature loop 130 (e.g., the portion of low pressure loop 130 downstream from expansion devices 142 and on the suction side of compressors 146) to limit the pressure in low temperature loop 130. According to one exemplary embodiment, low-side valve 196 is a relief valve that is configured to limit the low-side pressure in low temperature loop 130 to below a pressure of approximately 350 psig. High-side valve 198 is provided on the high pressure side of low temperature loop 130 (e.g., the portion of low pressure loop 130 downstream from compressors 146 and up to expansion devices 142) to limit the pressure in low temperature loop 130. According to one exemplary embodiment, high-side valve 198 is a relief valve that is configured to limit the high-side pressure in low temperature loop 130 to below approximately 550-600 psig.

Refrigeration system 110 may include a portion 190 (shown in more detail in FIGS. 8B and 8C) with solenoid valves 192 and check valves 194 that are configured to prevent pressure from rising above a predefined threshold in low temperature loop 130. A single solenoid valve 192 and check valve 194 may be provided on suction header 144 (see FIG. 8B) or solenoid valves 192 and check valves 194 may be provided for each individual circuit between low temperature cases 140 and suction header 144 (see FIG. 8C). Solenoid valve 192 is provided in-line with suction header 144 or an individual circuit feeding suction header 144. Check valves 194 are provided on lines connecting the low pressure side of low temperature loop 130 (e.g. suction header 144) to the high pressure side of low temperature loop 130 (e.g., supply header 138). According to exemplary embodiments in FIGS. 8B and 8C, solenoid valves 192 are provided upstream of subcooler 136. According to other exemplary embodiments, solenoid valves 192 may be provided downstream of subcooler 136 and upstream of compressors 146.

If the power for refrigeration system 110 is lost or otherwise interrupted, the cooling cycle keeping the CO2 refrigerant cooled may be halted and the temperature of the CO2 may rise, causing it to expand and threaten to damage components of refrigeration system 110, such as piping and components on low pressure side of low temperature loop 130 (e.g., suction header 144, individual circuits feeding suction header 144, evaporators in low temperature cases 150, etc) upstream of solenoid valves 192. Upon loss of power, solenoid valves 192 are configured to close and isolate compressors 146. When closed, solenoid valves 192 prevent possible damage to compressors 146 by isolating them from CO2 pressure built up in low temperature case 150 evaporators and suction distribution piping.

Expansion devices 142 may be electronically controlled and configured to close automatically upon loss of power. However, some refrigerant may continue to leak through closed expansion devices 142 from the high-pressure side to the low pressure side of low temperature loop 130. If the pressure on the low pressure side of low temperature loop 130 exceeds the pressure on the high pressure side, refrigerant may pass through check valves 194 from the low pressure side to the high pressure side. If the pressure in the high pressure side exceeds a predetermined threshold, it escapes (e.g. vents, etc.) from refrigeration system 110 through high-side relief valve 198.

According to any exemplary embodiment, the pressure relief devices are intended to minimize potential pressure related damage to the system in the event of a power loss. In the event that CO2 refrigerant leaks-by (e.g. bleeds-past, etc.) the expansion valves 142, the CO2 will remain in the evaporators of the low temperature loads (e.g. refrigerated cases or freezers, etc.) and will be cooled by the thermal inertia of the low temperature objects (e.g. food, etc.) stored therein. In this manner, the pressure of the CO2 refrigerant in the refrigeration loads can go to a higher pressure than the pressure relief setting of relief valve 196, and bypass check valves 194 are intended to ensure that under any condition, the pressure of CO2 refrigerant within the refrigeration loads does not exceed the pressure relief setpoint of the relief valve 198.

Figure 9:
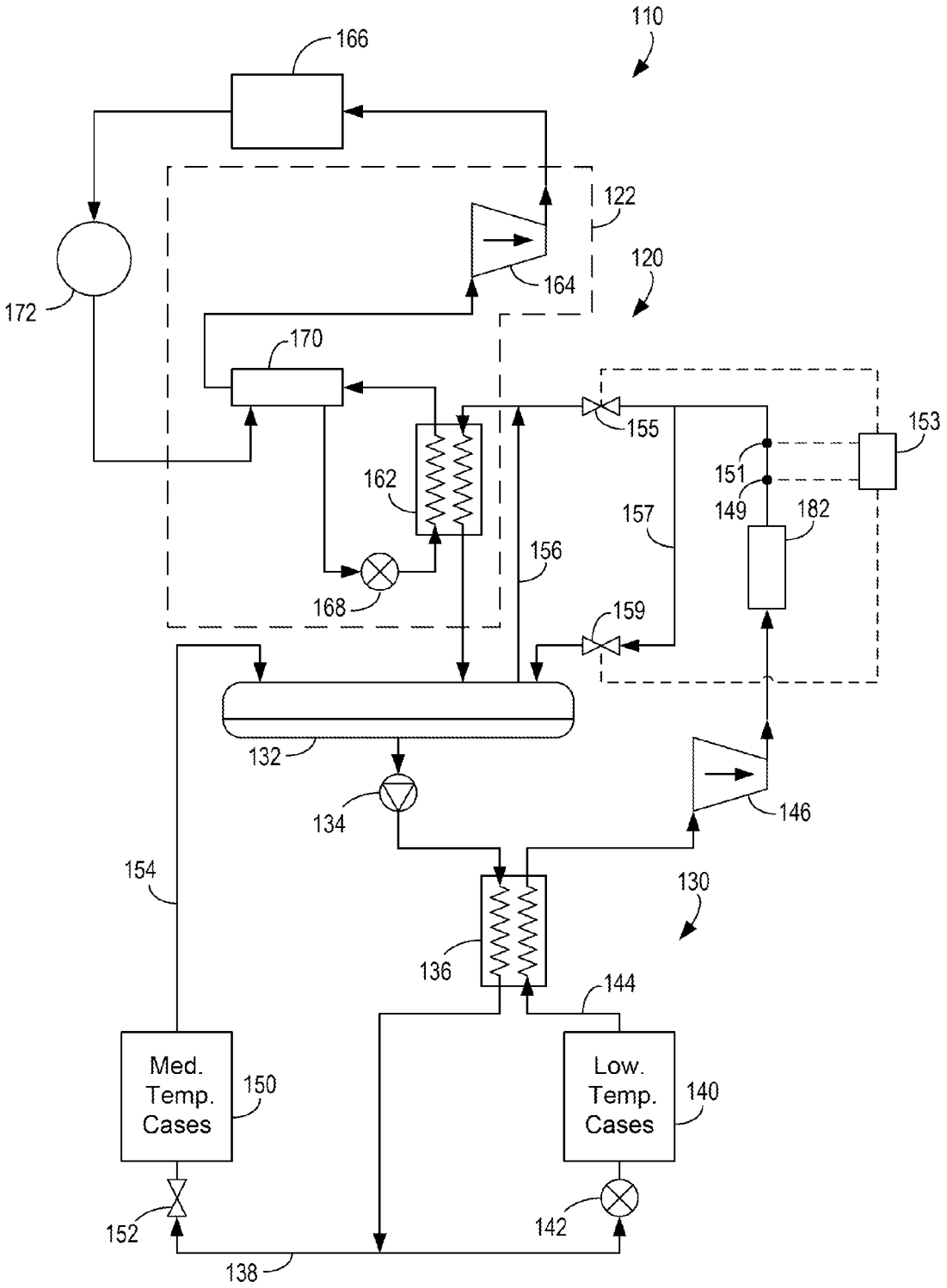
FIG. 9 is a block diagram of a cascade refrigeration system according to an exemplary embodiment using a CO2 refrigerant and having an external condensing heat exchanger.

Referring to FIG. 9, condensing for the CO2 refrigerant in the low temperature loop may be cooled by an outside ambient air-cooled heat exchanger, thus minimizing or eliminating the need for the upper cascade portion of the system, according to another embodiment. Under certain seasonal or climate temperature conditions, heat exchanger 182 may act as an air-cooled condenser when the local ambient (e.g. outside) air temperature is sufficiently low (e.g. in cold climates, during winter months, etc.). During such cold ambient conditions, the ambient air temperature may be sufficiently low (i.e. below a predetermined ambient air temperature) that the CO2 vapor refrigerant exiting compressor 146 may be substantially or completely condensed in heat exchanger 182. The condensed (e.g. liquid) CO2 refrigerant exiting heat exchanger 182 may then be routed through bypass line 157 directly to liquid-vapor separator 132, thus reducing or eliminating the need for operation of the medium temperature loop 120 and gaining the associated energy savings. A valve 159 (e.g. solenoid-operated valve, etc.) is provided on branch line 157 and is operable to open when the outside ambient air temperature is sufficiently low (i.e. below a predetermined temperature) that heat exchanger 182 can condense the CO2 vapor refrigerant exiting compressor 146. Valve 159 is also operable to close when the outside ambient air temperature rises and is no longer sufficient to condense the CO2 vapor refrigerant. Valve 159 may be controlled using any suitable controller and control scheme. For example, temperature and/or pressure sensing devices (shown as a temperature sensor 149 and a pressure sensor 151) may be provided on the outlet of heat exchanger 182 to provide signals representative of the temperature and pressure of the CO2 refrigerant exiting the heat exchanger. The signals representative of the CO2 refrigerant temperature and pressure may be provided to a control device (e.g. having a microprocessor or other suitable device—shown as controller 153) that determines whether the CO2 refrigerant exiting heat exchanger 182 is below the saturation temperature for the CO2 refrigerant. When controller 153 determines that the temperature of the CO2 refrigerant is below its saturation temperature (indicating that the ambient air temperature is below the predetermined temperature and the CO2 refrigerant has condensed to a liquid state), then controller 153 may provide an output signal to close valve 155 and to open valve 159. In a similar manner, when controller 153 determines that the temperature of the CO2 refrigerant is at or above its saturation temperature (indicating that the ambient air temperature is above the predetermined temperature and the CO2 refrigerant has not condensed to a liquid state), controller 153 may provide a signal to close valve 159 and open valve 155 to direct the cooled (but not yet condensed) CO2 refrigerant to heat exchanger 162 of the medium temperature cooling loop for further cooling. Heat exchanger 182 is intended to permit the option of converting the source of cooling for the CO2 refrigerant from the medium temperature cooling loop 120 to an outside heat exchanger 182 to provide "free cooling" during periods when the outside ambient air temperature is sufficiently low.

While the refrigerant for low temperature loop 130 has been described above as CO2, it should be realized that the arrangement of low temperature loop 130 allows various refrigerants to be used in both a liquid state and a vapor state to cool medium temperature cases 150 and low temperature cases 140. For example, according to anther exemplary embodiment, the low temperature refrigerant may be propane, ammonia or any other suitable refrigerant.

It is important to note that the construction and arrangement of the elements of the refrigeration system provided herein are illustrative only. Although only a few exemplary embodiments of the present invention(s) have been described in detail in this disclosure, those skilled in the art who review this disclosure will readily appreciate that many modifications are possible in these embodiments (such as variations in features such as connecting structure, components, materials, sequences, capacities, shapes, dimensions, proportions and configurations of the modular elements of the system, without materially departing from the novel teachings and advantages of the invention(s). For example, any number of chiller units may be provided in parallel to cool the low temperature and medium temperature cases, or more subsystems may be included in the refrigeration system (e.g., a very cold subsystem or additional cold or medium subsystems). Further, it is readily apparent that variations and modifications of the refrigeration system and its components and elements may be provided in a wide variety of materials, types, shapes, sizes and performance characteristics. Accordingly, all such variations and modifications are intended to be within the scope of the invention (s).

What is claimed is:

1. A cascade CO2 refrigeration system, comprising:

a medium temperature loop for circulating a medium temperature refrigerant, the medium temperature loop including a heat exchanger having a first side and a second side, the first side configured to evaporate the medium temperature refrigerant and a medium temperature compressor, a condenser, and a medium temperature expansion device packaged in a modular unit with the heat exchanger;

a low temperature loop for circulating a CO2 refrigerant, the low temperature loop including:

a low temperature discharge header configured to circulate the CO2 refrigerant through the second side of the heat exchanger, the second side of the heat exchanger configured to condense the CO2 refrigerant;

a liquid-vapor separator configured to collect liquid CO2 refrigerant and to direct vapor CO2 refrigerant to the second side of the heat exchanger;

a pump;

a liquid CO2 refrigerant supply header;

a plurality of medium temperature loads configured to receive liquid CO2 refrigerant from the liquid CO2 refrigerant supply header for use as a liquid coolant in the medium temperature loads and to discharge the CO2 refrigerant directly to the liquid-vapor separator;

a plurality of low temperature loads;

a low temperature expansion device associated with the low temperature loads and configured to expand the liquid CO2 refrigerant from the liquid CO2 refrigerant supply header into vapor CO2 refrigerant for use as a vapor refrigerant by the low temperature loads.

2. The cascade CO2 refrigeration system of claim 1 further comprising a return header configured to direct vapor CO2 refrigerant from the medium temperature loads to the liquid-vapor separator.

3. The cascade CO2 refrigeration system of claim 2 wherein the CO2 refrigerant from the medium temperature loads is in a combined liquid-vapor state.

4. The cascade CO2 refrigeration system of claim 1 further comprising a low temperature suction header configured to direct CO2 refrigerant from the low temperature loads to one or more low temperature compressors.

5. The cascade CO2 refrigeration system of claim 4 wherein the CO2 refrigerant from the low temperature loads is vapor CO2 refrigerant.

6. The cascade CO2 refrigeration system of claim 5 wherein the vapor CO2 refrigerant from the low temperature loads is configured to provide cooling to a low temperature subcooler.

7. The cascade CO2 refrigeration system of claim 1 further comprising a plurality of the modular units coupled to the liquid-vapor separator.

8. The cascade CO2 refrigeration system of claim 1, further comprising an air-cooled heat exchanger disposed upstream of the heat exchanger and configured to use ambient air to pre-cool the CO2 refrigerant.

9. A cascade refrigeration system having a common subcooled liquid supply for both low temperature refrigerated cases and medium temperature refrigerated cases, the system comprising:

an upper cascade portion for circulating a first refrigerant, the upper cascade portion including an upper cascade compressor, an upper cascade condenser, an upper cascade expansion device, and a heat exchanger having a first side and a second side, the first side configured to evaporate the first refrigerant;

a lower cascade portion for circulating a second refrigerant, the lower cascade portion including a lower cascade compressor configured to direct the second refrigerant to the second side of the heat exchanger, the second side of the heat exchanger configured to condense the second refrigerant, a liquid-vapor separator configured to direct liquid second refrigerant to the common subcooled liquid supply and to direct vapor second refrigerant to the second side of the heat exchanger;

a plurality of medium temperature refrigerated cases configured to receive liquid second refrigerant from the common subcooled liquid supply for use as a coolant in the medium temperature refrigerated cases and to discharge the second refrigerant directly to the liquid-vapor separator, and an expansion device associated with a plurality of the low temperature refrigerated cases and configured to expand the liquid second refrigerant from the common subcooled liquid supply for use in the low temperature refrigerated cases.

10. The cascade refrigeration system of claim 9 wherein the second refrigerant comprises CO2.

11. The cascade refrigeration system of claim 9 wherein the first refrigerant comprises one of propane and ammonia.

12. The cascade refrigeration system of claim 9 further comprising a return header configured to direct second refrigerant in a combined liquid-vapor state from the medium temperature refrigerated cases to the liquid-vapor separator.

13. The cascade refrigeration system of claim 9 further comprising a lower cascade suction header configured to direct second refrigerant from the low temperature refrigerated cases to a lower cascade heat exchanger configured to subcool the liquid second coolant from the liquid-vapor separator.

14. The cascade refrigeration system of claim 9 wherein the upper cascade compressor, the upper cascade condenser, the upper cascade expansion device, and the heat exchanger are packaged in a modular unit.

15. The cascade refrigeration system of claim 14 further comprising a plurality of the modular units coupled to the liquid-vapor separator and configured to condense vapor second refrigerant.

16. The cascade refrigeration system of claim 9 further comprising a de-superheating heat exchanger disposed between the lower cascade compressor and the heat exchanger and configured to pre-cool the second refrigerant before entering the heat exchanger.

17. The cascade refrigeration system of claim 9 further comprising a pump configured to direct the liquid second refrigerant from the liquid-vapor separator to the medium temperature refrigerated cases.

18. A cascade refrigeration system having a common liquid supply for both low temperature refrigeration loads and medium temperature refrigeration loads, the system comprising:

an upper cascade portion for circulating a first refrigerant, the upper cascade portion including an upper cascade compressor, an upper cascade condenser, an upper cascade expansion device, and a heat exchanger having a first side and a second side, the first side configured to evaporate the first refrigerant;

a lower cascade portion for circulating a second refrigerant, the lower cascade portion including a lower cascade compressor configured to direct the second refrigerant to the second side of the heat exchanger, the second side of the heat exchanger configured to condense the second refrigerant;

a liquid-vapor separator configured to receive the liquid second refrigerant from the second side of the heat exchanger and to provide a source of liquid second refrigerant for the common liquid supply;

a plurality of medium temperature refrigeration loads configured to receive liquid second refrigerant from the common liquid supply for use as a coolant in the medium temperature refrigeration loads and to discharge the second refrigerant directly to the liquid-vapor separator, and an expansion device associated with a plurality of the low temperature refrigeration loads and configured to expand the liquid second refrigerant from the common liquid supply into a liquid-vapor mixture for use in the low temperature refrigeration loads.

19. The cascade refrigeration system of claim 18 wherein the second refrigerant is CO2.

20. The cascade refrigeration system of claim 18 wherein the CO2 refrigerant is returned from the medium temperature refrigeration loads to the liquid-vapor separator, and the liquid vapor separator directs the CO2 refrigerant in vapor form to the second side of the heat exchanger.

21. The cascade refrigeration system of claim 18 further comprising a lower cascade heat exchanger having a first side and a second side; the first side configured to receive liquid second refrigerant from the liquid-vapor separator, and the second side configured to receive vapor second refrigerant from the low temperature refrigeration loads.

22. The cascade refrigeration system of claim 18 further comprising a pump configured to direct the liquid second refrigerant from the liquid-vapor separator to the medium temperature refrigeration loads.

23. A cascade refrigeration system having a common liquid supply for both low temperature refrigeration loads and medium temperature refrigeration loads, the system comprising:

an upper cascade portion for circulating a first refrigerant, the upper cascade portion including an upper cascade compressor, an upper cascade condenser, an upper cascade expansion device, and a heat exchanger having a first side and a second side, the first side configured to evaporate the first refrigerant;

a lower cascade portion for circulating a CO2 refrigerant, the lower cascade portion including a lower cascade compressor configured to direct the second refrigerant to the second side of the heat exchanger, the second side of the heat exchanger configured to condense the second refrigerant;

a de-superheating heat exchanger disposed between the lower cascade compressor and the heat exchanger and configured to pre-cool the CO2 refrigerant before entering the heat exchanger;

a liquid-vapor separator configured to direct vapor CO2 refrigerant to the second side of the heat exchanger and to receive the liquid CO2 refrigerant from the second side of the heat exchanger and to provide a source of liquid CO2 refrigerant for the common liquid supply;

a plurality of medium temperature refrigeration loads configured to receive liquid CO2 refrigerant from the common liquid supply for use as a coolant in the medium temperature refrigeration loads, and at least one expansion device associated with a plurality of the low temperature refrigeration loads and configured to expand the liquid CO2 refrigerant from the common liquid supply for use in the low temperature refrigeration loads.

24. A cascade refrigeration system having a liquid supply for both low temperature refrigeration loads and medium temperature refrigeration loads, the system comprising:

an upper cascade portion for circulating a first refrigerant, the upper cascade portion including an upper cascade compressor, an upper cascade condenser, an upper cascade expansion device, and a heat exchanger having a first side and a second side, the first side configured to evaporate the first refrigerant;

a lower cascade portion for circulating a CO2 refrigerant, the lower cascade portion including a lower cascade compressor configured to direct the second refrigerant to the second side of the heat exchanger, the second side of the heat exchanger configured to condense the second refrigerant;

a receiver configured to direct vapor CO2 refrigerant to the second side of the heat exchanger and to receive the liquid CO2 refrigerant from the second side of the heat exchanger and to provide a source of liquid CO2 refrigerant for the liquid supply;

at least one expansion device associated with a plurality of the low temperature refrigeration loads and configured to expand the liquid CO2 refrigerant from the liquid supply for use in the low temperature refrigeration loads;

at least one valve disposed on a piping section between the low temperature refrigeration loads and the lower cascade compressor; and at least one check valve disposed between the piping section and the common liquid supply.

25. The cascade refrigeration system of claim 24 wherein the valve comprises a solenoid valve configured to close upon a loss of power to the system.

26. The cascade refrigeration system of claim 25 further comprising a relief valve configured to release CO2 from at least one of the common liquid supply and the liquid-vapor separator.

27. The cascade refrigeration system of claim 26 wherein the check valve is configured to permit flow of CO2 refrigerant from the low temperature refrigeration loads to the relief valve when a pressure of the CO2 refrigerant in the low temperature refrigeration load exceeds a predetermined pressure setpoint of the relief valve.

28. The cascade system of claim 25 wherein the liquid supply comprises a common liquid supply and further comprising a plurality of medium temperature refrigeration loads configured to receive liquid CO2 refrigerant from the common liquid supply for use as a coolant in the medium temperature refrigeration loads.

29. The cascade system of claim 28 wherein the receiver comprises a liquid-vapor separator and further comprising a pump configured to deliver liquid CO2 refrigerant from the liquid vapor separator to the low temperature refrigeration loads and the medium temperature refrigeration loads via the common liquid supply.

* * * * *